US006113104A

United States Patent [19]

Forslund et al.

[11] Patent Number: 6,113,104

[45] Date of Patent: Sep. 5, 2000

[54] SEALING DEVICE

[75] Inventors: Kjell Forslund; Anders Bergdahl, both of Sundsbruk; Klas Kristrom̈ , Kovland, all of Sweden

[73] Assignee: Valmet Fibertech Aktiebolag, Sweden

[21] Appl. No.: 08/981,209

[22] PCT Filed: Jun. 24, 1996

[86] PCT No.: PCT/SE96/00821

§ 371 Date: Dec. 30, 1997

§ 102(e) Date: Dec. 30, 1997

[87] PCT Pub. No.: WO97/02384

PCT Pub. Date: Jan. 23, 1997

[30] Foreign Application Priority Data

Jul. 3, 1995 [SE] Sweden ..... 9502400

[51] Int. Cl.[7] ..... F16J 15/16

[52] U.S. Cl. ..... 277/370

[58] Field of Search ..... 277/371, 370, 277/551

[56] References Cited

U.S. PATENT DOCUMENTS

| | | | |
|---|---|---|---|
| 3,420,373 | 1/1969 | Hunter | 209/273 |
| 3,497,060 | 2/1970 | Tra et al. . | |
| 3,547,267 | 12/1970 | Sutherland | 209/240 |
| 3,759,533 | 9/1973 | Neely | 277/545 |
| 4,083,504 | 4/1978 | Wattles et al. | 241/275 |
| 4,198,373 | 4/1980 | Kropp et al. | 422/49 |
| 4,287,055 | 9/1981 | Holz . | |
| 4,732,396 | 3/1988 | Brigham et al. | 277/306 |
| 5,275,421 | 1/1994 | Hornsby | 277/370 X |
| 5,324,048 | 6/1994 | Carmody | 277/370 X |
| 5,344,164 | 9/1994 | Carmody et al. | 277/370 X |
| 5,409,350 | 4/1995 | Mitchell | 415/111 |

FOREIGN PATENT DOCUMENTS

| | | |
|---|---|---|
| 0 294 832 | 12/1988 | European Pat. Off. . |
| 436 431 | 12/1984 | Sweden . |

*Primary Examiner*—Anthony Knight
*Assistant Examiner*—Alison K. Pickard
*Attorney, Agent, or Firm*—Lerner, David, Littenberg, Krumholz & Mentlik, LLP

[57] ABSTRACT

Apparatus for sealing rotary shafts supported by bearings within an airtight casing and extending into a housing maintained at an overpressure is disclosed including a mechanical shaft seal for sealing the shaft as it passes into the housing, a seal mount mounted on the casing for mounting the mechanical shaft seal, the casing including an opening to provide access to the mechanical shaft seal within the casing, and a removable airtight cover for sealing the opening in the casing during operation of the apparatus.

4 Claims, 1 Drawing Sheet

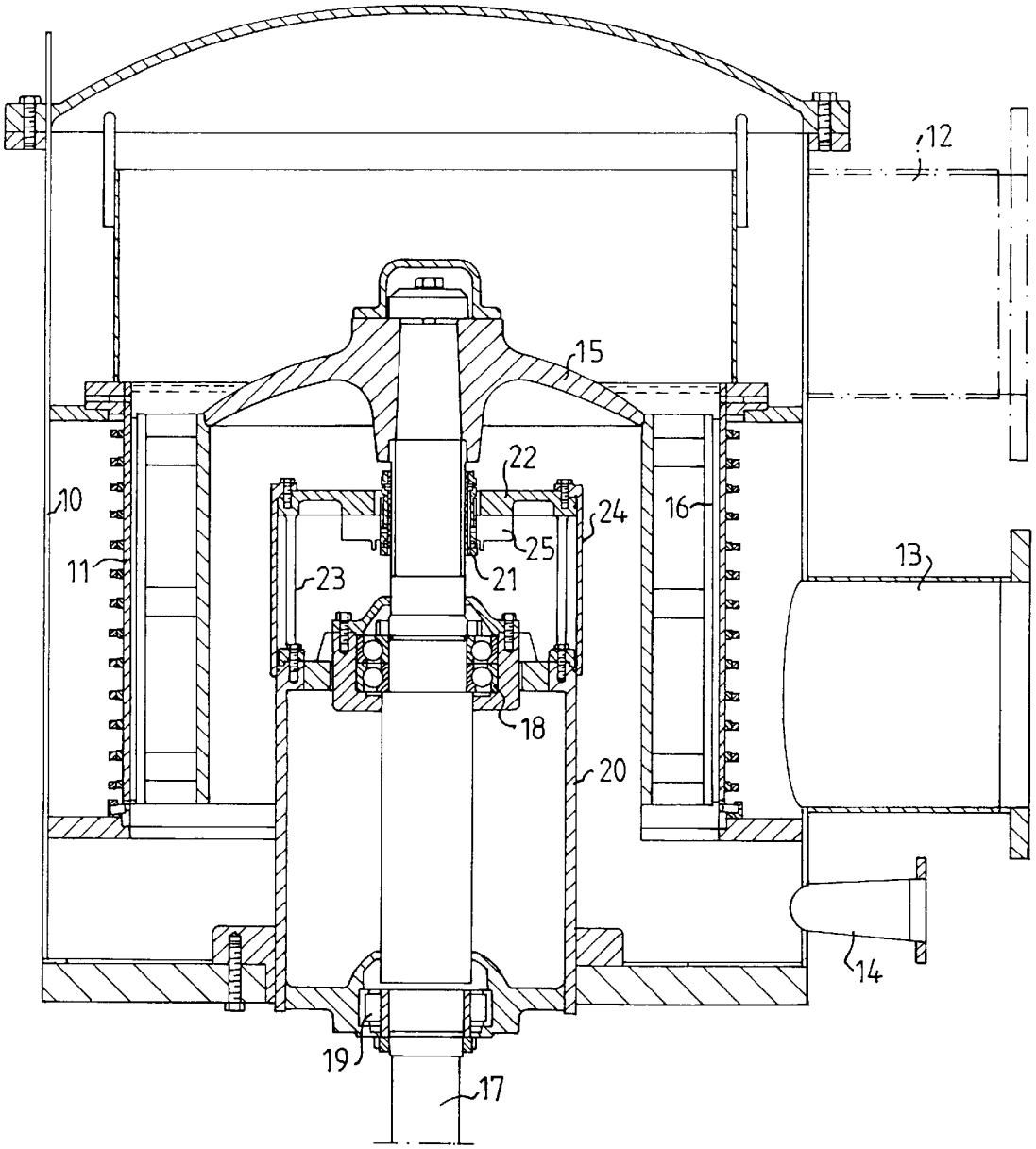
12
15
22
10
24
16
25
11
23
21
13
18
20
14
19
17

SEALING DEVICE

FIELD OF THE INVENTION

The present invention relates to a device for sealing a rotary shaft extending into a container, in which overpressure is maintained. More particularly, the present invention relates to such a device which can be used, for example, in a pressurized screen for the screening of pulp suspensions, in which case the container is the airtight housing of the pressurized screen.

BACKGROUND OF THE INVENTION

A pressurized screen for the screening of pulp suspensions comprises an airtight housing, in which a screening member is located. The housing has an inlet for the pulp suspension and outlets for accept and rejection portions, respectively. In order to promote the screening process, the pulp suspension is caused to flow along the screening member, and the accept portion passes through the screening member, which can be rotary or stationary. In the latter case, the rotor is located in the housing for generating the flow along the screening member.

The rotor of the rotary screening member in such devices is mounted on a shaft, which is driven by a motor located outside the housing. The shaft is supported in bearings and extends into the housing. The housing is pressurized and, therefore, a seal is provided where the shaft enters the housing. In order to provide stability for the shaft, an internal axial bearing is located in an airtight casing, which extends into the housing. The seal is mounted in a seal holder between the casing and the interior of the housing inside the internal bearing.

This structural design has the disadvantage that the external (atmospheric) side of the shaft seal is accessible only after the entire shaft with its bearings has been dismounted. This results in the fact that conventional shaft seals of the mechanical seal type, for example a so-called cartridge seal, cannot be applied. In many cases this is a considerable disadvantage, because it requires complicated structures and lengthy dismantling work at the time of seal exchange.

The present invention has the object of eliminating the aforesaid problems. The device according to the present invention, therefore, renders it possible for the shaft seal side located outside the container, i.e. in the casing, to be made accessible during seal exchange in a simple manner.

SUMMARY OF THE INVENTION

In accordance with the present invention, these and other objects have now been accomplished by the discovery of apparatus for sealing a rotary shaft supported by bearings within an airtight casing and extending from the airtight casing into a housing maintained at an overpressure, which comprises a mechanical shaft seal for sealing the shaft as it passes into the housing, seal mounting means mounted on the casing for mounting the mechanical shaft seal, the casing including at least one opening for providing access to the mechanical shaft seal within the casing, and a removable airtight cover for sealing the at least one opening in the casing during operation of the apparatus. Preferably, the mechanical shaft seal comprises a mechanical cartridge seal.

In accordance with a preferred embodiment of the apparatus of the present invention, the apparatus includes O-ring means for sealing the removable cover to the casing. In a preferred embodiment, the casing is mounted within a pressurized screen for the screening of a pulp suspension.

BRIEF DESCRIPTION OF THE DRAWINGS

The present invention may be more fully appreciated with reference to the following detailed description, which, in turn, refers to the drawing which is a side, elevational, partially sectional view of the apparatus of the present invention used in connection with a pressurized screen for the screening of a pulp suspension.

DETAILED DESCRIPTION

Referring to the drawings, a pressurized screen for screening pulp suspensions comprises an airtight housing 10, in which a stationary screening member 11 is located. The housing has an inlet 12 for the suspension and outlets 13 and 14 for accept and reject portions, respectively. A rotor 15 is located outside the screening member 11 and is provided with pulsation means 16, which move along the screening member 11 in order to promote the screening process. The rotor 15 is supported on a shaft 17, which is mounted in an upper (inner) bearing 18 and a lower (outer) bearing 19. The shaft 17 extends into the housing 10 and is enclosed by an airtight casing 20 in which the bearings, 18 and 19, are located. Above (inside of) the upper (inner) bearing 18, the passage of the shaft 17 into the housing 10 is sealed by a mechanical seal 21, preferably a mechanical cartridge seal, which is mounted in a seal holder 22 attached to the casing 20. The object of the seal 21 is to resist the overpressure in the housing 10 and prevent the pulp suspension from penetrating into the bearing space in the casing 20.

In order to render it possible to gain access to the side of the seal 21 located in the casing 20, the casing is provided with openings 23. The casing portion comprising the openings 23 preferably is detachably attached to the unbroken portion of the casing. During operation of the shaft the openings 23 are closed by a detachable airtight cover 24, preferably in the form of a cylindrical sleeve. The cover 24 is attached sealingly to the seal holder 22 and extends past the openings 23 so as to seal against the unbroken portion of the casing 20. The seals of the cover 24 preferably are O-rings.

The gland 25 of the mechanical seal 21 is attached to the seal holder 22, and the seal portion rotating with the shaft is attached to the shaft. The seal is both attached and dismounted by means of the openings 23, after the detachable cover 24 has been removed.

In order to exchange the mechanical seal 21, the housing 10 is opened and the rotor 15 is dismounted. Thereafter, the airtight cover 24 is removed, whereby the mechanical seal 21 is accessible through the openings 23 and can be removed from the shaft. The transport protection for the seal can also be dismounted through the openings 23.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for sealing a rotary shaft supported by bearings within an airtight casing and extending from said airtight casing into a housing maintained at an overpressure, said apparatus comprising a mechanical shaft seal for sealing said shaft as said shaft passes into said housing, seal mounting means mounted on said casing for mounting said mechanical shaft seal, said casing including at least one opening for providing access to said mechanical shaft seal within said casing so that said mechanical shaft seal can be removed from said shaft, and a removable air tight cover for sealing said at least one opening in said casing during operation of said apparatus.

2. The apparatus of claim 1 wherein said mechanical shaft seal comprises a mechanical cartridge seal.

3. The apparatus of claim 1 including means for sealing said removable cover to said casing.

4. The apparatus of claim 1 wherein said casing is mounted within a pressurized screen for screening of a pulp suspension.

* * * * *